United States Patent [19]

Whitney

[11] 4,046,142

[45] Sept. 6, 1977

[54] BEAUTY PADDLE

[76] Inventor: Dorothy Whitney, 1200 N. 33, Renton, Wash. 98055

[21] Appl. No.: 675,574

[22] Filed: Apr. 9, 1976

[51] Int. Cl.[2] ..... A61H 23/00

[52] U.S. Cl. ..... 128/55; 128/56

[58] Field of Search ..... 128/54–59, 128/24.2, 62

[56] References Cited

U.S. PATENT DOCUMENTS

| | | | |
|---|---|---|---|
| 2,095,634 | 10/1937 | Gibson et al. | 128/55 |
| 2,224,880 | 12/1940 | Nessler | 128/62 |
| 2,671,443 | 3/1954 | Holland | 128/24.2 |
| 2,911,660 | 11/1959 | Klemas et al. | 128/56 X |
| 3,802,423 | 4/1974 | Pfaendler | 128/55 |

*Primary Examiner*—Lawrence W. Trapp

*Attorney, Agent, or Firm*—Allen D. Brufsky

[57] ABSTRACT

An electric motor driven rotatable multiple bladed beauty paddle.

6 Claims, 2 Drawing Figures

BEAUTY PADDLE

BACKGROUND OF THE INVENTION

1. Field of the Invention

This invention relates to stimulating devices for skin and circulation and in particular, to striking devices. It pertains especially to repetitive, cyclic tools and to power driven tools for the purpose.

2. Prior Art

The concept of slapping the skin to improve circulation is pre-historic and probably started in response to shock, freezing, drowning and the like. In primitive cultures, slapping the skin for appearance alteration is common. The various beauty and similar paddles found upon search were all for manual, unpowered swatters as disclosed by:

| | U.S. Pat. No. |
|---|---|
| Gray | 1478388 |
| Strelitz | 1827616 |
| Koment | 1915190 |
| Dibble | 1966789 |
| Knapp | 1973768 |
| Briggs | 2054849 |
| Tupper | 3867928 |

Summary

It is therefore an object of this invention to overcome the limitations and disadvantages in the beauty paddle devices in the prior art and currently available in the market.

One of the objects of the invention is to provide a beauty paddle device embodying improved principles of design and construction.

An important object of the invention is to provide a beauty paddle device which is comprised of a number of simple parts and components which can be economically manufactured and readily assembled.

A significant object of the invention is to provide a beauty paddle device, so designed and constructed that it can be easily applied by almost any body.

Another object of the invention is to provide powered beauty paddle for repeatedly and gently striking the surface of the skin to provide a stimulating action.

A further object of the invention is to provide a relatively soft paddle.

Yet another object of the invention is to provide a manually held paddle equipped with control means.

A beauty paddle, according to the principles of this invention, comprises a rotatable multiple bladed paddle, a driving means such as an electric motor, a control means such as a switch, and a source of or a connection to an energy supply.

Further objects and advantages of this invention will appear more clearly from the following description of a non-limiting illustrative embodiment and the accompanying drawings in which like numerals designate like parts thruout the several views.

DESCRIPTION OF DRAWINGS

Briefly summarized, a preferred embodiment of the invention is described in conjunction with an illustrative disclosure thereof in the accompanying drawings, in which.

DESCRIPTION OF TYPICAL EMBODIMENT

Figure 1:
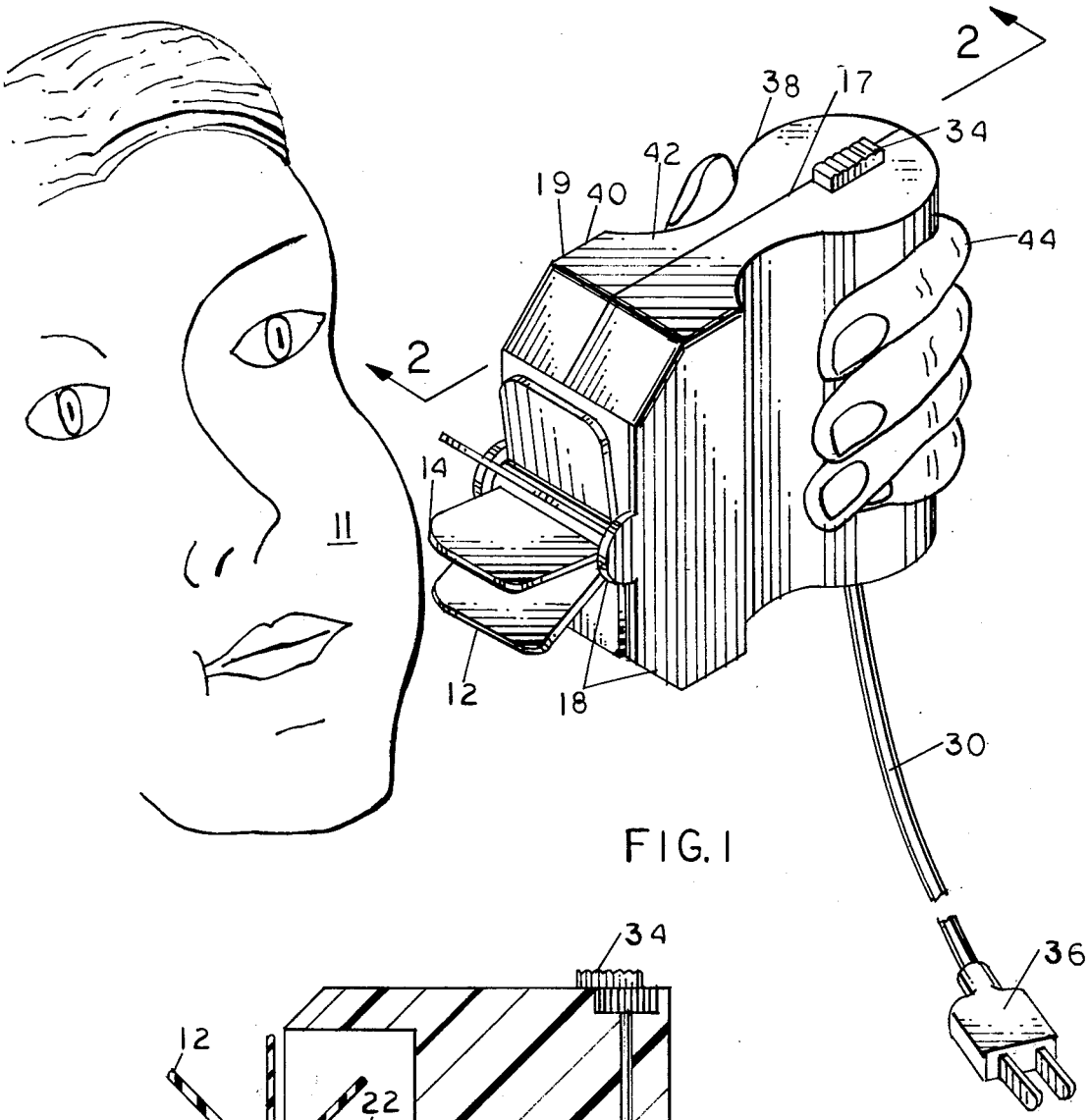
FIG. 1 is a pictorial representation of the beauty paddle in use gently massaging a cheek according to the principles of this invention.
Figure 2:
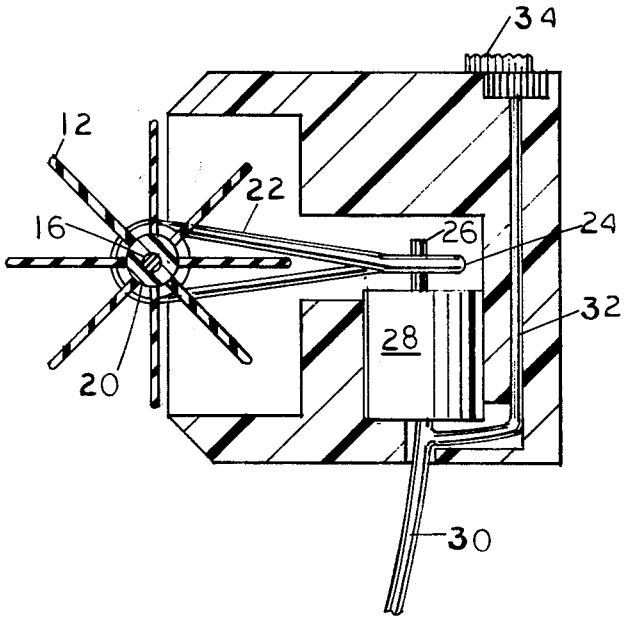
FIG. 2 is a cross sectional view of the beauty paddle taken substantially along line 2—2 of FIG. 1.

In the drawings a beauty paddle embodying features of the invention is illustrated in which the paddle leaf 14 is in contact with cheek 11 and leaf 12 is moving away from the cheek rotating on shaft 16 retained in housing 18, 19 and rotated by belt 22 passing about pulley 20 and driven by electric motor 28 via pulley 24 mounted upon motor shaft 26.

For convenience of construction, the belt 22 maybe twisted out of plane up to 90°.

In order to provide various levels of stimulation, a multiple speed or variable speed motor may be provided controlled by an electric switch 34 connected to the motor by wiring 32.

The electric motor 28 may receive its energy from an electric storage battery pack or via an electric power cord 30 and plug 36 from an external energy source.

The housing may be made in two parts 18, 19 joined at seam 17 as is convenient for manufacturing and servicing or it may have a contour described by protuberances 38, 40 separated by hollow 42 for convenience in manual 44 retention.

In use, the paddle may be held to the face or further away and the speed varied to select the desired level of stimulation.

The beauty paddle may be made of known materials by known manufacturing methods. A soft paddle of a rubber or plastic composition would probably be most sympathetic to the skin.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A hand held beauty paddle for the stimulation of the skin and blood circulation comprising a rotatable multiple bladed paddle mounted to a housing having a contour with protuberances and hollows for easy manual retention and split into two parts and provided with electric motor driving means for the paddle via a power transmission belt twisted through an angle such as 90°.

2. A paddle as in claim 1 further comprising a control means.

3. A paddle as in claim 2 wherein the control means is an electric switch.

4. A paddle as in claim 1 wherein the paddle is relatively soft so as not to bruise the skin against which it moves.

5. A paddle as in claim 4 wherein the paddle is comprised of a rubber composition.

6. A paddle as in claim 4 wherein the paddle is comprised of plastic.

* * * * *